United States Patent [19]

Larinoff

[11] 4,235,571

[45] Nov. 25, 1980

[54] COOLING EQUIPMENT

[75] Inventor: Michael W. Larinoff, Houston, Tex.

[73] Assignee: Hudson Products Corporation, Houston, Tex.

[21] Appl. No.: 844,574

[22] Filed: Oct. 25, 1977

[51] Int. Cl.[3] ..... F04B 49/00

[52] U.S. Cl. ..... 417/1; 165/DIG. 1; 415/14; 415/219 R; 417/12

[58] Field of Search ..... 417/1, 38, 312, 424, 417/12; 415/1, 9, 174, 129, 131, 140, 141, 14, 219 R; 416/61, 247 R

[56] References Cited

U.S. PATENT DOCUMENTS

| | | | |
|---|---|---|---|
| 1,326,651 | 12/1919 | Doran | 415/9 |
| 1,326,867 | 12/1919 | Junggren | 415/9 |
| 1,469,045 | 9/1923 | MacMurchy | 415/9 |
| 2,604,050 | 7/1952 | Wilson | 415/174 |
| 2,664,242 | 12/1953 | Se Bastian | 416/247X |
| 2,707,440 | 5/1955 | Long et al. | 417/12 |
| 2,857,095 | 10/1958 | Grau | 416/247 X |
| 2,942,683 | 6/1960 | Moyer | 417/312 |
| 3,224,666 | 12/1965 | Ljungstrom et al. | 415/174 |
| 3,261,544 | 7/1966 | Guichard | 416/247 X |
| 3,591,308 | 7/1971 | Blattner | 415/9 |
| 3,768,546 | 10/1973 | Shipes | 165/DIG. 1 |
| 3,799,703 | 3/1974 | Paine et al. | 417/312 |
| 4,016,725 | 4/1977 | Fiss | 165/DIG. 1 |
| 4,123,197 | 10/1978 | Keem et al. | 416/247 R |

FOREIGN PATENT DOCUMENTS

| | | | |
|---|---|---|---|
| 27740 | of 1912 | United Kingdom | 415/9 |

*Primary Examiner*—Carlton R. Croyle
*Assistant Examiner*—Edward Look
*Attorney, Agent, or Firm*—Marvin B. Eickenroht; Jennings B. Thompson

[57] ABSTRACT

Cooling equipment is disclosed as having an axial flow fan whose blades are restrained from excessive bending in an axial direction.

19 Claims, 9 Drawing Figures

COOLING EQUIPMENT

This invention relates generally to mechanical draft cooling equipment, and more particularly, to improvements in axial flow fans used in such equipment.

The blades of large diameter fans of this type are susceptible to breakage due to excessive ambient air pressure forces, which may occur because of explosion or tornadoes, or even wind gusts if the fan is disposed in their direct path. The blades act structually as cantilever beams and are capable of bending to a limited extent in an axial direction during normal operating conditions. However, when deflected or damaged excessively as a result of abnormal pressure forces, such as those above noted, the blades may break at their connection to the fan hub. This is particularly true when the blades are made of plastic, as is preferred because of their lower weight and cost compared with metal blades.

If a fan of this type were to be used in the ultimate heat sink cooling system of a nuclear power plant, blade breakage could be catastrophic. That is, this or other causes of sustained breakdown in operation of the fan would literally permit the plant to burn itself out. Less catastrophic, yet serious, consequences could result from blade breakage of a fan mounted in a vertical plane at the base of a natural draft tower, and thus in the direct path of wind gusts.

An object of this invention is to provide a fan of this type in which the blades are prevented from breaking, even when subjected to excessive ambient air pressure forces; and, more particularly, in which the blades are restrained from bending beyond permissible limits, without substantial interference with air flow through the fan and without sustained interruption of the normal operation of the fan.

Another object is to provide such a fan having a means for so restraining the blades which is of inexpensive and simple construction, and further which is adaptable to installation on existing fans.

These and other objects accomplished, in accordance with the illustrated embodiments of the present invention, by an axial flow fan of this type having at least one substantially circular rail mounted generally concentrically of the ring on one side, and preferably both sides, of the blades for engaging them upon excessive bending in an axial direction. Although the invention contemplates that there may be one such substantially circular rail mounted on one or both sides of the blades to engage either portions of the blades near the outer ends or portions of the blades intermediate their inner and outer ends, there are preferably two such rails arranged concentrically of one another for engaging both such portions of the blades.

In one illustrated embodiment of the invention, the circular rails are mounted on struts which are in turn mounted on the fan ring for extension inwardly therefrom. As will be appreciated, the struts define air flow paths between them which, together with the rails, restrict air flow through the fan to only a minor extent. Obviously, in the event excessive bending is to be restrained in both axial directions, such struts would be mounted on both sides of the blades. Preferably, the struts are arranged in arcuate segments mountable in side by side relation within the fan ring, and the rail comprises arcuate segments each carried by a strut segment to dispose them in end to end relation.

Although the frictional drag on the blades due to their engagement with the rails will induce bending stresses in the blades, they should not be so excessive as to break the blades. For one thing, these stresses occur in a direction trasverse to the axis of the fan, and thus, approximately in line with the edge-to-edge width of the blades, at least at their outer ends, where the blades provide maximum resistance to bending.

Furthermore, one or both of the edges of the blades and surfaces of the rails with which they are engageable are of low friction material to reduce the frictional drag to a minimum. Preferably, this is accomplished by pads on the affected portions of the blade edges so as to also serve as wear surfaces to protect the blades.

In the further interest of avoiding damage to the blades upon engagment with the rails, and recognizing that the air pressure waves due to a tornado or explosion are ordinarily of momentary duration, a means is also provided for only momentarily discontinuing the external power supply for rotating the blades upon bending toward, but short of, engagement with the rails. Thus, a means is provided for sensing bending of the blades toward their limited position, and for only momentarily deenergizing the rotating means in response to the sensed bending. In the illustrated embodiment of the invention, such means comprises a micro switch mounted on at least one strut for engaging blades, as it is so bent, and a means connecting the switch to the means for rotating the blades for so deenergizing it.

During this momentary deenergization of the rotating means, the only force operating on the blades is the inertia of the fan and the means for rotating it, so that the overall air and friction loads on each blade, and thus the stress levels at their inner ends, is materially reduced. On the other hand, the momentary interruption of power to the rotating means is hardly noticed by the media to be cooled since the air pressure waves would, during the interval, have imparted additional air flow to supplement that lost by the momentary deceleration of the fan.

In another embodiment of the invention, which of simpler construction, a circular rail, is mounted directly on the fan ring for engaging portions of the blades adjacent their outer ends on one side or both sides of the blades. This embodiment is especially well suited for shorter blades, which may be restrained without support intermediate their inner and outer ends.

In further preferred embodiments of the invention, the sides of the struts on the downstream side of the blades are arranged to straighten out the air flow through the blades, and the sides of those on the upstream side are arranged to deflect the flow of air into the path of the blades. In this manner, the struts also serve as vanes to increase the overall efficiency of the fan.

As illustrated by the different embodiments of the invention to be described below, it has application to both wet cooling towers and dry cooling towers, or air coolers, and the expression "cooling equipment", as used herein, is generic to both.

In the drawings, wherein like reference characters are used throughout to designate like parts:

Figure 1:
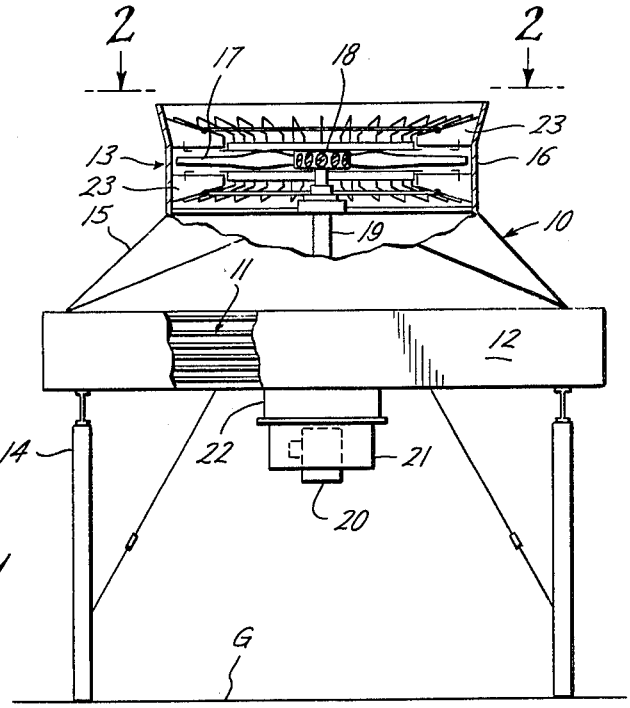
FIG. 1 is a side view of an air cooler which is broken away in part to show an axial flow fan mounted above a tube bundle in position to cause air to flow upwardly across the bundle, the fan being constructed in accordance with the first described embodiment of the invention.
Figure 2:
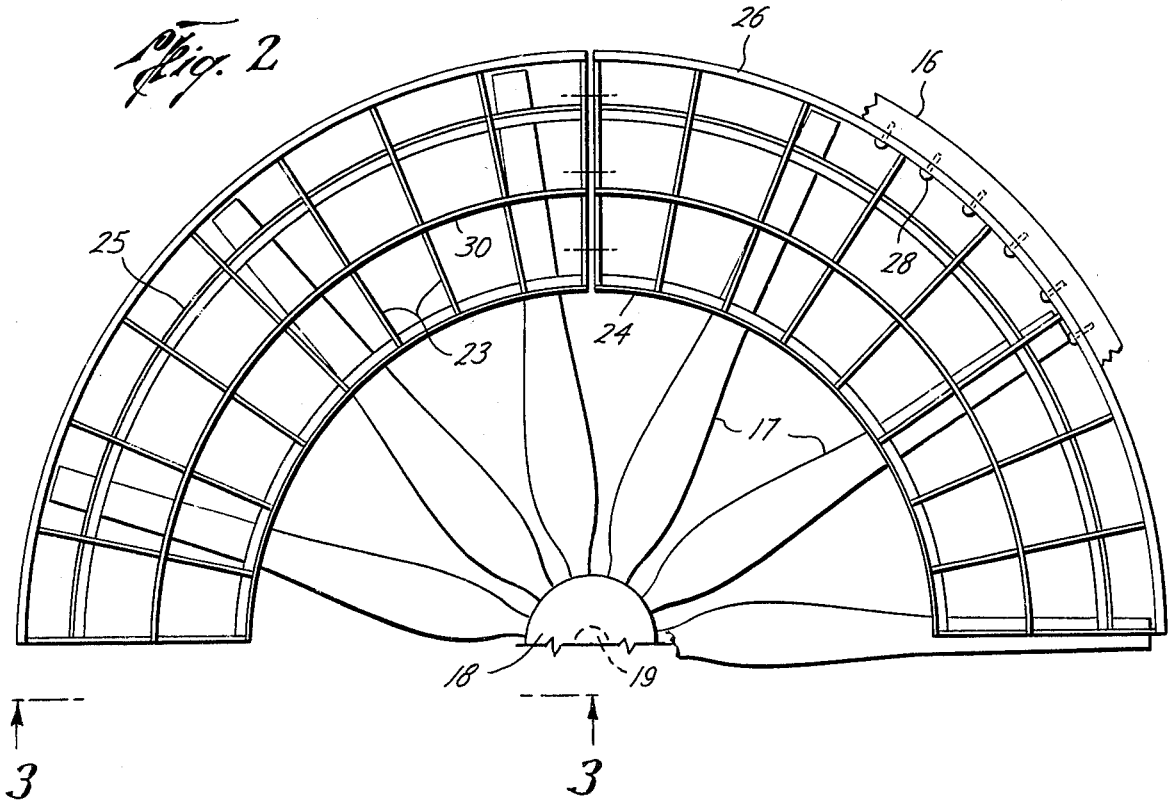
FIG. 2 is an enlarged partial top plan view of the fan as seen along broken lines 2—2 of FIG. 1.
Figure 3:
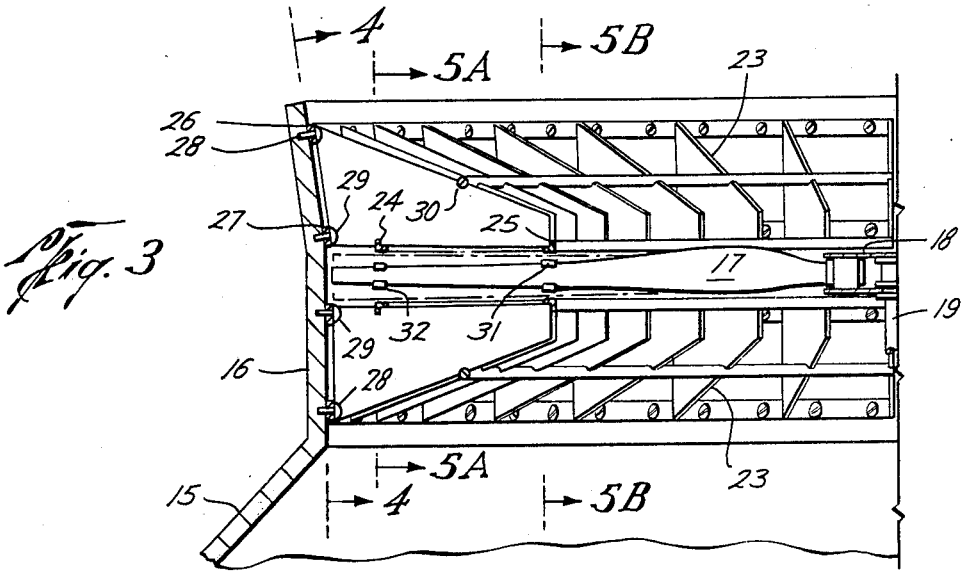
FIG. 3 is a partial vertical sectional view of the fan of FIGS. 1 and 2, as seen along broken lines 3—3 of FIG. 2.
Figure 4:
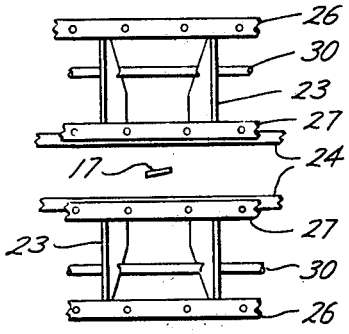
FIG. 4 is a view of part of a strut segment of the fan of FIG. 3, as seen along broken lines 4—4 thereof.

With reference now to the details of the drawings, the air cooler shown in FIG. 1, and designated in its entirety by reference character 10, includes a tube bundle 11 supported by a housing 12 having walls surrounding its four sides, and a fan 13 mounted above the bundle for drawing air upwardly across the tubes thereof so as to cool the medium circulating therethrough. Housing 12 is supported above ground level G by means of legs 14 so that air may be drawn upwardly across the bundle, and fan 13 is mounted above the housing by means of a shroud 15 to confine the air flow from the bundle out the upper end of the fan 13.

Fan 13 includes a ring 16 which connects with and forms an upper continuation of the upper end of shroud 15, and a phurality of blades 17 mounted on a hub 18 for rotation within the ring. More particularly, the hub is mounted on a shaft 19 which is disposed coaxially of the fan ring and which is rotated by means of motor 20 carried by a motor support 21 and drivingly engaged with the shaft through a belt disposed within a belt guard 22.

The fan includes a large number of blades which, as shown, are relatively thin, but wider from edge to edge near their inner ends than at their outer ends. Also, and as best shown by a comparison of FIGS. 5A and 5B, the blades are twisted intermediate their inner and outer ends so that their pitch lessens toward their outer ends. As previously described, the blades are preferably hollow and made of reinforced plastic to reduce their weight, although they may be made of metal.

In the preferred embodiment of the invention illustrated in FIGS. 1-6, a series of struts 23 are mounted on and extends inwardly from the fan ring above and below the blades. More particularly, the upper and lower series of struts carry substantially circular rails 24 and 25 on their lower and upper edges, respectively. More particularly, and as previously described, the rails are disposed concentrically of the axis of the fan and one another and so spaced from the opposite sides of the blades as to engage them upon bending which is excessive in the sense that, if not restrained, it would break the blades.

As will be appreciated, since each blade is loaded as a cantilever, the portions thereof near its outer ends will deflect upwardly or downwardly a greater distance those intermediate its inner and outer ends. On the other hand, due to the twist of the blades, as shown by a comparison of FIGS. 5A and 5B, it might be necessary to mount the outer rails 24 somewhat closer to the blades in their normal unbent positions than the inner rails 25 in order that the blades will engage both rails at about the same time.

As shown, each strut 23 is a thin, flat sheet which extends vertically in the direction of air flow and horizontally in a generally radial direction to approximately the mid portion of the length of the blades. The struts are arranged in segments, with several struts forming each segment and with the segments mounted in side by side relation within the fan ring. The rails 24 and 25 are also formed in arcuate segments, with the segment of each such rail mounted on a strut segment, whereby, upon mounting of the strut segments on the fan ring, the rail segments are in substantially end to end relation.

Each strut segment includes mounting rings 26 and 27 which are secured to and extend about the outer edges of the struts adjacent to their upper and lower ends so as to hold them in equally spaced relation. As shown, these mounting rings are then bolted, as shown in 28 and 29, to the fan ring so as to mount the segments in side by side relation within the ring. The struts of each segment are reenforced and also held in uniformly space apart relation by means of a ring segment 30 secured to their upper edges intermediate their inner and outer ends. The struts are further reinforced by the segments of the substantially circular ring 24 and 25 secured to their upper and lower edges at their inner ends and near their outer ends.

In the interest of reducing the frictional drag upon blades as they engage the rails, each blade is preferably provided with pads 31 and 32 of Teflon or other material having a low coefficient of friction with respect to the metal rails on the portions of their upper and lower edges, respectively, engagable with the rails. In addition to reducing frictional drag, these pads provide wear surfaces which prevent damage to the blades themselves.

Figure 6:
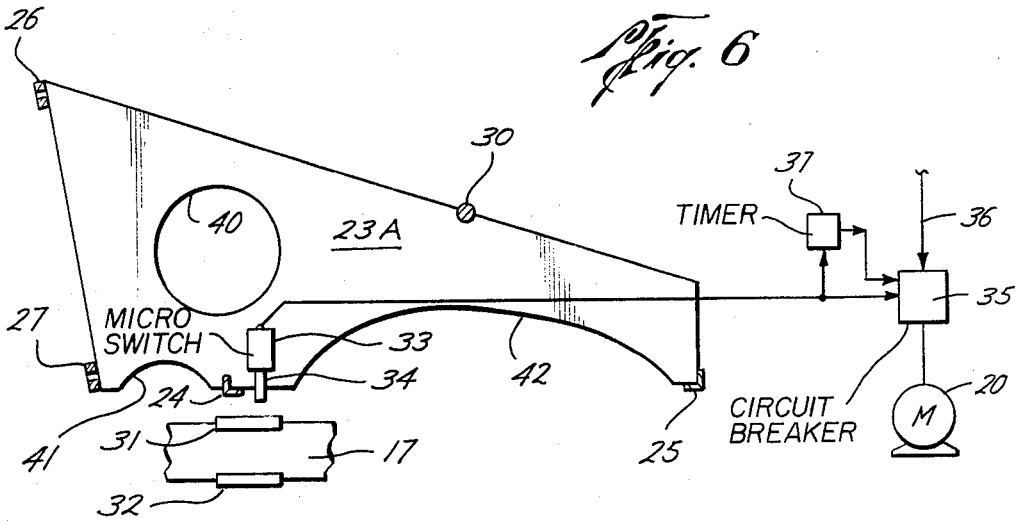
FIG. 6 is an enlarged detailed view of a modified form of strut, together with a diagramatic illustration of a micro switch carried thereby and the electrical circuit connecting the switch to the fan motor for deenergizing the motor on only a momentary basis.

As previously described, a means is also provided for momentarily deenergizing the motor 20 upon deflection of the blade toward, but prior to engagement with the rails, so as to reduce the frictional drag on the blades should they continue to bend outwardly into engagement with the rails. As also previously mentioned, since this interruption of power for rotating the blades is only momentary, there is no substantial loss in the cooling capacity of the fans, and thus no risk of catastrophic damage to the power plant from which heat is to be removed. For this purpose, and as best shown in FIG. 6, a micro switch 33 is mounted on one or more of the struts above and below the blades with its spring pressed lever 34 in a position to be pivoted by the wiping action of the blades just prior to their engagement with the rails. The switch is electrically connected to a circuit breaker 35 in line 36 supplying electrical current to the motor, so that pivoting of lever 34 will trip the circuit breaker 35 to deenergize motor 20. The switch also connects with and activates a timer 37 leading to the circuit breaker so as to resume the supply of electrical power to the motor to reenergize it after a short delay, of only a matter of seconds.

Strut 23A shown in FIG. 6 is a modified form of less weight in that it has a hole 40 formed in its tall portion near its outer edge, and cut outs 41 and 42 formed in its lower edge, the smaller cut out 41 being formed between its outer end and the outer rail 24, and the larger cut out 42 being formed intermediate the outer and inner rails.

Figure 5A:
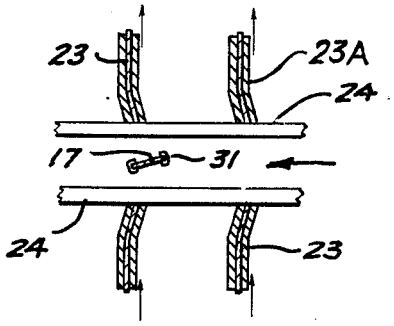
FIGS. 5A and 5B are partial sectional views of a modified form of the fan, as taken along broken lines 5A—5A and 5B—5B, respectively, of FIG. 3.
Figure 5B:
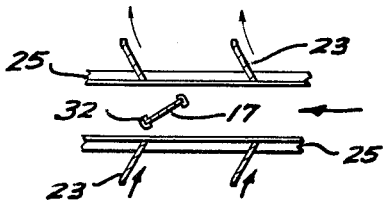

As previously described, the struts serve a dual purpose in that, in addition to supporting the rails, they tend to straighten out the swirling air flow produced by rotation of the blades, and thereby increase the overall efficiency of the fan. For this purpose, and as shown in FIGS. 5A and 5B, the lower struts are bent to direct air flow from beneath the fan into the path of the blades, and the upper struts are bent to straighten out the flow of air leaving the blades. More particularly, the upper portions of the lower struts extend generally parallel to the face of the blades, and the lower portions of the upper struts extend generally perpendicular to the face of the blades. Additionally, as shown in FIG. 5A, accoustical material 23A may be applied to the sides of the struts so as to lower the noise level of the fan.

Figure 7:
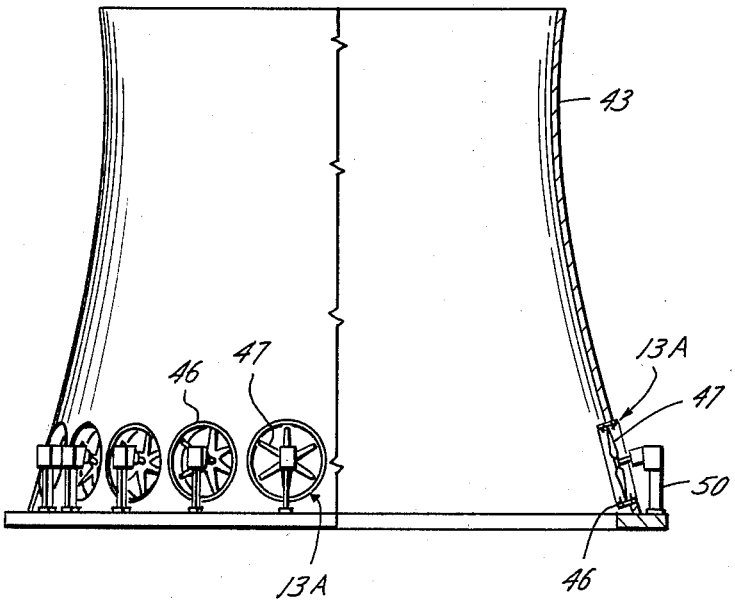
FIG. 7 is side view, broken away in part, of a natural draft wet cooling tower having mechanical draft assistance about its base in the form of vertically arranged axial flow fans constructed in accordance with the second described embodiment of the invention.
Figure 8:
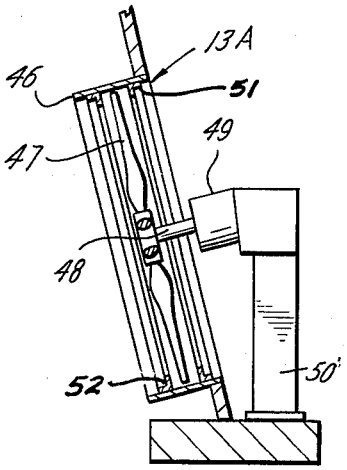
FIG. 8 is an enlarged sectional view of the fans of FIG. 7 indicated by the encircled portion of FIG. 7.

In the other embodiment of the invention illustrated in FIGS. 7 and 8 a plurality of axial flow fans 13A are mounted in generally upright positions about the base of a hyperbolic natural draft tower 43. As well known in the art, Fill (not shown) is arranged within the lower end of the tower in the path of air drawn into the tower with the mechanical draft assist of fans 13A for flow upwardly there through and out the upper end thereof, and water is collected in a tray (not shown) above the fill and permitted to pass through holes in the tray so as to trickle through the fill.

As best shown in FIG. 8, each fan 13A includes a ring 46 mounted within the lower end of the tower 43 and blades 47 mounted on a shaft 48, for rotation coaxially of and within ring 46. Shaft 48 is rotated by means of a motor 49 mounted on a support 50. Each blade is of generally the shape and construction described in connection with the first embodiment.

As also shown in FIG. 8, rails 51 and 52 are mounted directly on the fan ring on opposite sides of the blades 47 in position to engage the portions of the blades adjacent their outer ends upon excessive bending. In this embodiment, as in the prior embodiment, each rail is an angle having one leg which forms the rail surface itself, although, as compared with the first embodiment, the other leg of each rail forms a means of direct attachment to the fan ring.

As previously described, this embodiment of the invention is well suited for relatively short blades. Since the rails do not require support other than their direct attachment to the fan ring, each may be a continuous circle, rather than segments providing a substantially full circle. As in the case of the prior embodiment, a means such as that shown in FIG. 6, may also be provided, as by mounting on the rails themselves on the fan ring, for only momentarily deenergizing the fan motor.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. Cooling equipment including an axial flow fan having a ring, a hub rotatable about the axis of the ring, means for so rotating the hub, blades mounted on and extending from the hub for rotation within the ring, the ring fitting closely about the tips of the blades and overlapping opposite sides of the lateral projection of the blades, and a substantially circular rail having a continuous, planar surface mounted on the ring on one side of the blades and generally concentrically of the ring in order to engage and thus restrain bending of the blades in an axial direction.

2. Cooling equipment of the character defined in claim 1, including another substantially circular rail mounted on the other side of the blades and generally concentrically of the ring in order to engage and thus restrain bending of the blades in the opposite axial direction.

3. Cooling equipment of the character defined in claim 1, including means for sensing bending of the blades toward but prior to engagement with said rail, and means responsive to the sensing of said bending for only momentarily deenergizing said rotating means.

4. Cooling equipment of the character defined in claim 1, wherein the rail is mounted in position to engage portions of the blades near their outer ends.

5. Cooling equipment of the character defined in claim 1, wherein the rail is mounted in position to engage portions of the blades intermediate their inner and outer ends.

6. Cooling equipment of the character defined in claim 1, including another substantially circular rail mounted on said one side of the blades and generally concentrically of the ring and radially inwardly of the mentioned rail in order to engage portions of the blades intermediate their inner and outer ends.

7. Cooling equipment of the character defined in claim 1, wherein pads of low friction material are mounted on the opposite edges of the portions of the blades engageable with the rail.

8. Cooling equipment including an axial flow fan having a ring, a hub rotatable about the axis of the ring, means for so rotating the hub, blades mounted on and extending from the hub for rotation within the ring, the ring fitting closely about the tips of the blades and overlapping opposite sides of the lateral projection of the blades, struts mounted on the ring and extending inwardly therefrom on one side of the blades, and a substantially circular rail having a continuous, planar surface mounted on the struts generally concentrically of the ring in order to engage and thus restrain bending of the blades in an axial direction.

9. Cooling equipment of the character defined in claim 8, including additional struts mounted on the ring and extending inwardly therefrom on the other side of the blades, and another substantially circular rail mounted on the additional struts generally concentrically of the ring in order to engage and thus restrain bending of the blades in the opposite axial direction.

10. Cooling equipment of the character defined in claim 9, wherein the sides of the struts on the side of the blades toward which air is moved are arranged to straighten the flow of air as it leaves the blades, and the sides of the struts on the other side of the blades are arranged to deflect the flow of air into the path of the blades.

11. Cooling equipment of the character defined in claim 8, wherein said rail is positioned to engage portions of blades near their outer ends.

12. Cooling equipment of the character defined in claim 11, including another substantially circular rail mounted on the struts generally concentrically of the ring and radially inwardly of the first mentioned rail in order to engage portions of the blades intermediate their opposite ends.

13. Cooling equipment of the character defined in claim 8, wherein said rail is positioned to engage portions of the blades intermediate their opposite ends.

14. Cooling equipment of the character defined in claim 8, wherein the struts are arranged in arcuate segments mountable in side by side relation within the ring, and the rail comprises arcuate segments each mounted on a strut segment to dispose them in substantially end to end relation.

15. Cooling equipment of the character defined in claim 8, including a switch mounted on at least one strut in position to engage the blades upon bending but prior to engagment with the rail, and means connecting the switch to the rotating means for only momentarily de-energizing the rotating means.

16. Cooling equipment of the character defined in claim 8, wherein the struts are mounted on the side of the blades toward which the air is moved and the opposite sides thereof are arranged to straighten the flow of air as it passes therethrough.

17. Cooling equipment of the character defined in claim 8, wherein acoustical material is applied to the sides of the struts.

18. Cooling equipment including an axial flow fan having a ring, a hub rotatable about the axis of the ring, means for so rotating the hub, blades mounted on and extending from the hub for rotation within the ring, the ring fitting closely about the tips of the blades and overlapping opposite sides of the lateral projection of the blades, and a substantially circular rail having a continuous, planar surface mounted on the ring on one side of the blades in position to engage their outer portions adjacent their outer ends and thus limit their bending in an axial direction.

19. Cooling equipment of the character defined in claim 18, including another substantially circular rail mounted on the ring on the other side of the blades in position to engage their outer portions adjacent their outer ends and thus limit their bending in the opposite axial direction.

* * * * *